United States Patent [19]

Surber, Jr.

[11] 4,060,177

[45] Nov. 29, 1977

[54] STAMP DISPENSING APPARATUS

[76] Inventor: John L. Surber, Jr., 11818 Warfield Drive, San Antonio, Tex. 78216

[21] Appl. No.: 707,656

[22] Filed: July 22, 1976

Related U.S. Application Data

[63] Continuation of Ser. No. 548,248, Feb. 10, 1975, abandoned.

[51] Int. Cl.[2] ..... G07F 11/66

[52] U.S. Cl. ..... 221/25; 194/2; 226/135; 226/156

[58] Field of Search ..... 221/9, 13, 69, 70, 71, 221/74, 75, 25, 30, 258; 194/2, 10; 226/134, 135, 152, 156, 193

[56] References Cited

U.S. PATENT DOCUMENTS

| | | | |
|---|---|---|---|
| 1,813,935 | 7/1931 | Knee | 221/25 |
| 1,845,879 | 2/1932 | Knee | 221/25 |
| 3,131,830 | 5/1964 | Schaef | 221/25 |
| 3,655,109 | 4/1972 | Stevens | 226/135 X |
| 3,683,729 | 8/1972 | Cloud | 221/71 X |
| 3,782,616 | 1/1974 | Surber | 226/135 X |

*Primary Examiner*—Robert B. Reeves
*Assistant Examiner*—Joseph Rolla
*Attorney, Agent, or Firm*—Jennings B. Thompson

[57] ABSTRACT

An elongated web of stamps comprising a plurality of stamps connected together by a backing strip or longitudinally spaced transverse rows of perforations and formed into a roll is used in the dispensing apparatus disclosed. The stamp web is moved from the roll through an opening in the housing the distance required to position the desired number of stamps to be cut from the web each time the apparatus is actuated. To accurately position the web so that the web is cut along a connection between stamps such as a row of perforations, the web travels over a freely rotating indexing wheel having ridges positioned to engage the web at the connection between stamps only. The tension in the web during the dispensing operation and the structural weakness of the connection causes the web to bend at the line of contact with the ridges which insures that the wheel is rotated by the web without slippage and provides a very accurate means of controlling the position of the web when the dispensed stamps are severed from the web. Between dispensing operations, a roller exerts a resilient force on the web between two ridges in which the web is in contact, which holds the wheel and web in a known position for the start of the next vending operation.

6 Claims, 10 Drawing Figures

FIG.1
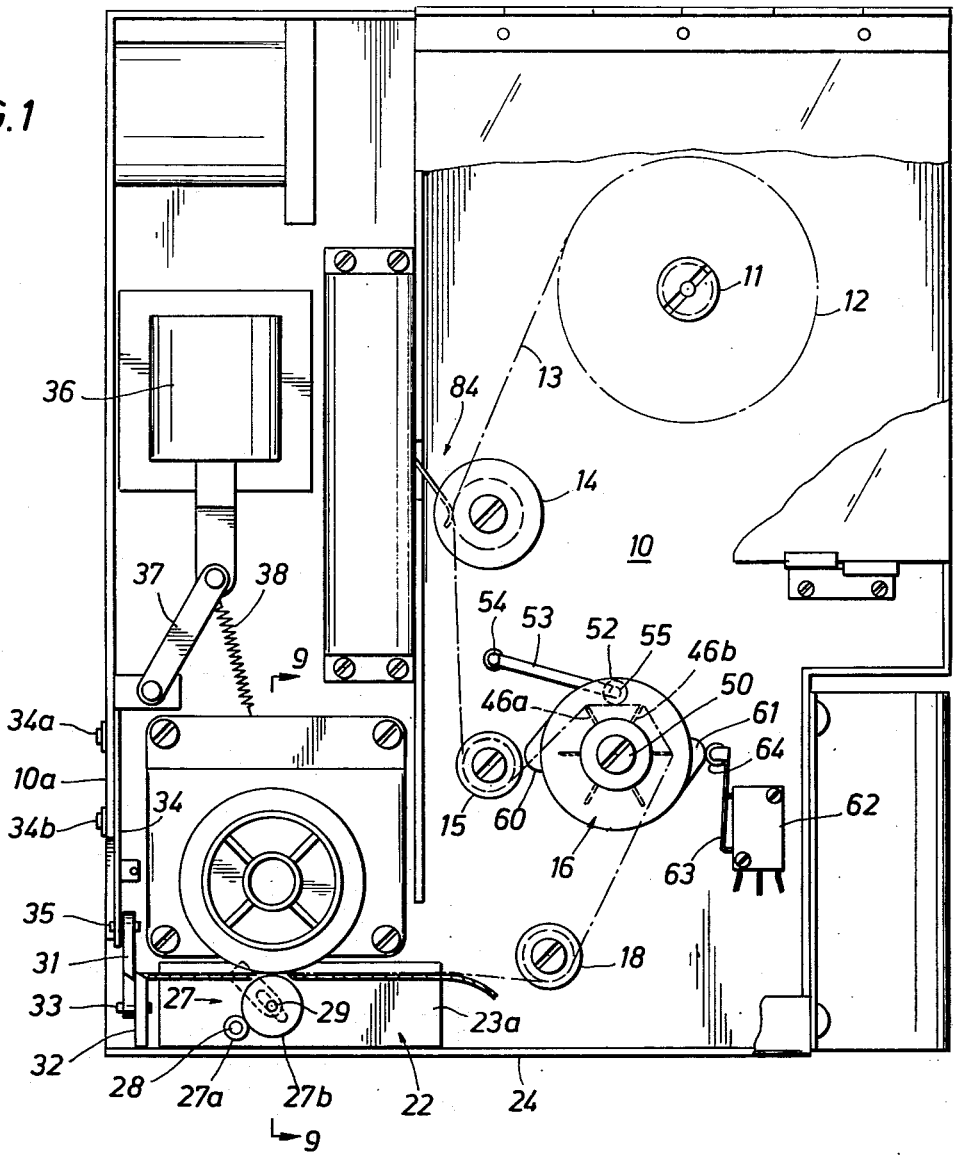
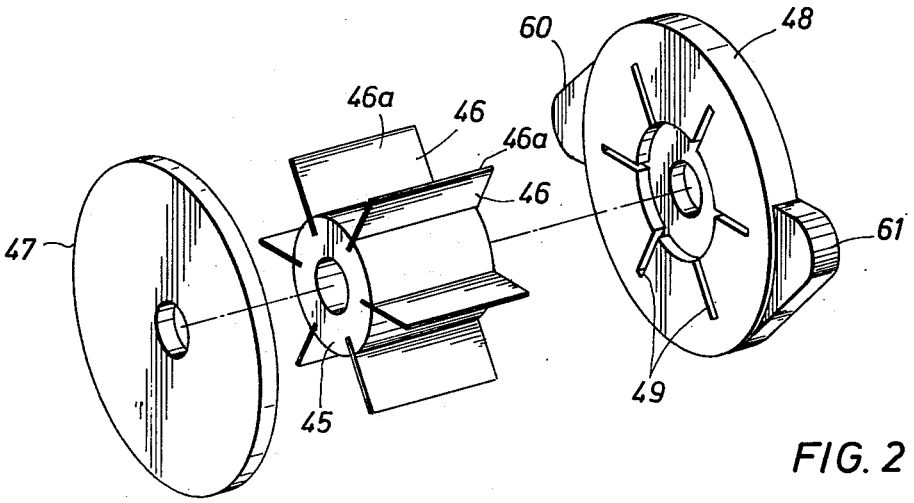
FIG. 2

FIG. 9
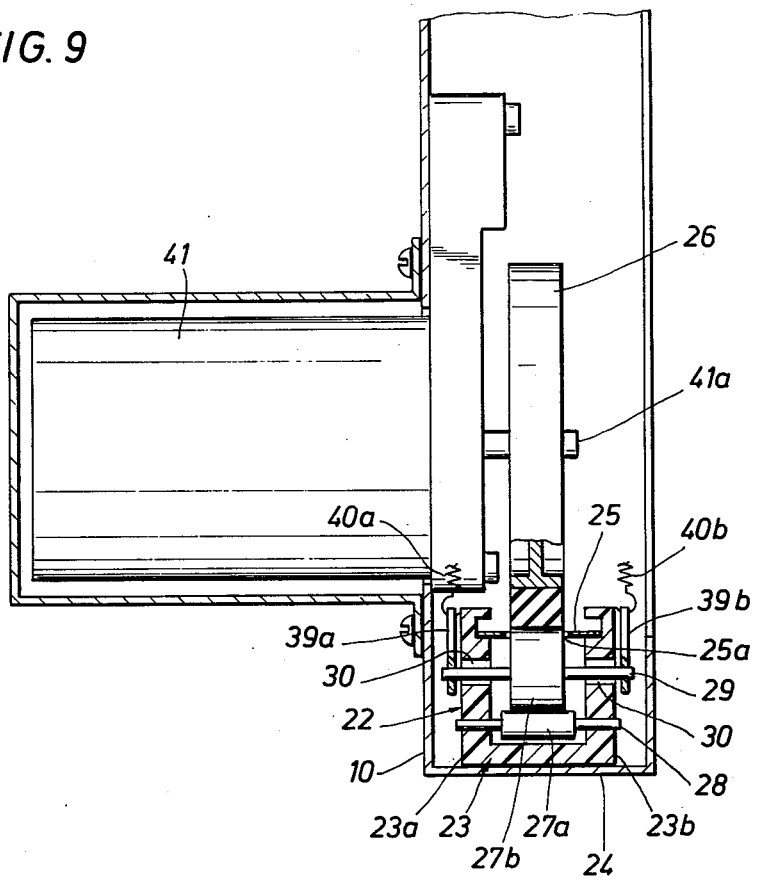
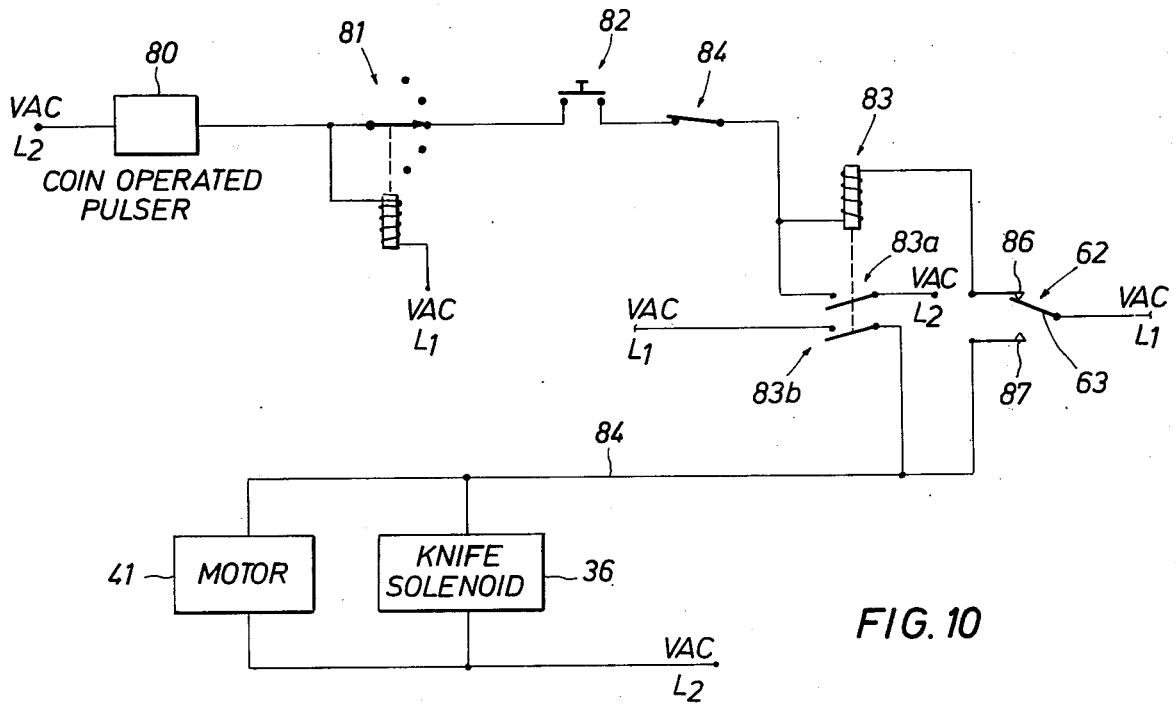
FIG. 10

STAMP DISPENSING APPARATUS

This is a continuation of application Ser. No. 548,248, filed Feb. 10, 1975, now abandoned.

This invention relates generally to dispensing apparatus for stamps, tickets, and the like, and in particular to such apparatus that dispenses from a rolled-up, elongated web comprising a plurality of stamps, tickets, or the like connected together by a continuous backing strip or by transverse rows of perforations.

Vending or dispensing apparatus of the type to which this invention relates, when actuated, moves the web from the roll until a preselected number of stamps or tickets are in position to be dispensed through an opening in the housing of the apparatus. The dispensed items are then severed from the web. This is usually done by a guillotine type knife blade that falls through the web to cut off the items dispensed. Since the position of the knife blade is fixed, the web must be positioned at the end of each vending or dispensing operation for the blade to cut the web at a connection between the dispensed items and the remainder of the web. This means that once the web is positioned properly, the distance the web is moved with each dispensing operation must be substantially constant with a minimum of variation. Otherwise, the blade will begin to cut into the items being dispensed rather than along the connection between them, thus mutilating at least one item with each operation of the apparatus. This is particularly important for stamp machines, of course, because of the intrinsic value of the stamps. It is also important that any error occurring in the movement of the web not be cummulative because many stamp dispensing machines operate unattended and dispense hundreds of stamps between service calls, and even a slight error in the cut off point, if cummulative, could not be tolerated.

It is an object of this invention to provide apparatus for dispensing items, such as stamps and tickets, from a web of such items that will consistently position the web at the end of a dispensing operation for the dispensed item or items to be severed from the web along the connection between the dispensed item or items and the remainder of the web.

It is another object of this invention to provide such a dispensing apparatus wherein any error that may occur in the movement of the web during one vending operation is not cummulative and will tend to be corrected in the next vending operation.

In most cases, the stamps or tickets in a roll of such items are connected by a transverse row of perforations that provide a weak place where the web will more readily tear. Previously, all commercial dispensing machines moved the web and/or positioned the web for the cut off operation by teeth or fingers that extended into the rows of perforations. This can cause damage to the stamps. Also, occasionally the perforations are not punched out and the teeth or fingers cannot enter resulting in a malfunction.

Therefore it is another object and an important feature of this invention to provide apparatus for dispensing stamps, tickets, and the like from a roll of such items that moves and indexes the web for cut off between the items without extending anything through the perforations in the web between the items.

It is another object of this invention to provide such apparatus having an indexing wheel in engagement with the web that is rotated without slippage by the moving web for accurately controlling the number of items, such as stamps, that are dispensed during each operation and that employs the structural weakness of the web at the connections between the items making up the web to position the web properly for each operation and to insure that there is no slippage between the wheel and the moving web.

These and other objects, advantages, and features of this invention will apparent to those skilled in the art from a consideration of this specification, including the attached drawings and appended claims.

In the drawings:

FIG. 1 is a side view, in elevation, of the preferred embodiment of the dispensing apparatus of this invention, with the outer case or housing removed;

FIG. 2 is an exploded, isometric view of the web positioning wheel used in the apparatus of FIG. 1;

FIGS. 3–8 are sectional views of web positioning wheels for dispensing different quantities of stamps, tickets, and the like;

FIG. 9 is a sectional view taken along line 9—9 of FIG. 1; and

FIG. 10 is a circuit diagram of the electrical system for the apparatus of FIG. 1.

Figure 3:
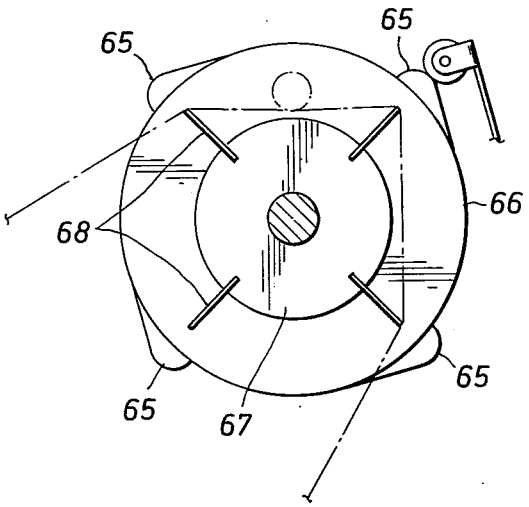

The apparatus in the drawings will be described as a stamp dispenser. It could be used, however, to dispense tickets and the like if desired.

Referring to FIG. 1, mounting plate 10 and its associated mounting flanges support the various components of the apparatus. Usually, all of the working parts are enclosed in a suitable case or housing having an opening through which the stamps are dispensed. The necessary operating levers, pushbuttons and the like, are also mounted on the housing.

As viewed in FIG. 1, shaft 11 is attached to mounting plate 10 in the upper right hand quadrant of the plate. Shaft 11 is designed to support stamp roll 12.

Stamp rolls, usually, are formed from a plurality of stamps connected together by transverse rows of perforations. There are stamp rolls now available, however, where the stamps are connected together through a continuous backing strip. As will be explained below, the fact that a stamp web will much more readily bend along a row of perforations is used to advantage by this invention. In the same manner, the backing strip will more readily bend between stamps. Therefore, "connection" as used in this specification, including the appended claims, means the portion of the web between stamps and includes the row of perforations and the backing strip.

The stamp web is unwound from its roll as the stamps are moved through the dispensing opening. The stamp web travels from roll 12 to the dispensing opening along the path indicated by dotted line 13. It first passes around roller 14, then to roller 15 where it makes about a 135° turn. It then passes around web positioning or indexing wheel 16, where it makes about a 180° turn before moving over roller 18 to begin its horizontal travel toward the dispensing opening in the housing (not shown) of the apparatus.

The stamp web is supported in its horizontal travel by track assembly 22. As best seen in FIGS. 1 and 9, this assembly includes U-shaped base 23 that is attached to bottom flange 24 of the mounting plate. The inside surface of arms **23*a* and 23*b* of the base have parallel horizontal grooves to receive and support plate 25. The grooves in the arms and plate 25** form a T-shaped groove or passageway that guides and supports the stamp web as it moves horizontally along the track.

Means are provided to move the stamp web each time the apparatus is actuated. In the embodiment shown, drive wheel 26 is positioned above the stamp web, and above opening 25*a* in plate 25, as shown in FIGS. 1 and 9. Idler wheel assembly 27 is positioned below the web and drive wheel 26. It includes roller 27*a* and movable wheel 27*b*. Roller 27*a* is mounted to freely rotate around the longitudinal axis of shaft 28. The shaft extends between and is supported by arms 23*a* and 23*b*. Movable wheel 27*b* is mounted to freely rotate around the longitudinal axis of shaft 29. Arms 23*a* and 23*b* have elongated slots 30 through which shaft 29 extends. These slots are designed to allow the shaft to be moved and, in turn, to move the wheel between the dispensing position shown in FIG. 1, where the stamp web is engaged between the drive and idler wheels, and a non-dispensing position where the idler wheel has moved out of engagement with the stamp web. Such movement is imparted to wheel 27*b* by the stamp web cutting apparatus that severs the stamp or stamps being dispensed from the stamp web.

When the stamp web has been moved the desired distance, the portion to be dispensed, whether one stamp or several, is severed from the rest of the stamp web by knife blade 31 moving downwardly through the stamp web past stationary blade 32. As shown in FIG. 1, movable blade 31 is pivoted at one end to stationary blade 32 by pin 33. The other end is pivoted to plate 34 by pin 35. Plate 34 is mounted on front flange 10*a* of mounting plate 10 by screws 34*a* and 34*b*. The screws extend through elongated mounting holes (not shown) that allow limited vertical movement of the plate relative to flange 10*a*. The plate is moved upwardly by solenoid 36 through line 37 to pivot movable blade 31 upwardly away from stationary blade 32. Solenoid 36, when energized, moves blade 31 up at the start of the vending operation against spring 38. At the end, it is deenergized and spring 38 moves blade 31 back to the closed position, cutting the stamps to be dispensed from the stamp web.

As stated above, in the embodiment shown, the movement of idler wheel 27*b* into and out of enagement with the stamp web is provided by the web cutting apparatus. As best seen in FIG. 9, shaft 29 is supported at each end by members 39*a* and 39*b*. Coil springs 40*a* and 40*b* are connected between members 39*a* and 39*b* and plate 34. When solenoid 36 is energized at the start of a dispensing operation, plate 34 is moved upwardly and springs 39*a* and 39*b* move idler wheel 27*b* into engagement with the stamp web below drive wheel 26 and roller 27*a*. Preferably, the point of contact between roller 27*a* and the idler wheel is located so that clockwise rotation of the drive wheel will tend to urge the idler wheel further between the drive wheel and the roller and thereby increase the force the idler wheel exerts on the stamp web and the drive wheel. The roller should be positioned, however, so that the idler wheel does not wedge between the roller and drive wheel so it is not free to return to its non-dispensing position. After the vending operation, the downward movement of the knife and plate 34 allows the idler wheel to move out of engagement with the stamp web. By having the gummed side of the web toward the idler wheel, this removes the possibility of any sticking of the web to the wheel while the apparatus is inactive.

Preferably, the drive and idler wheels have rims of elastomeric material so they will grip the stamp web firmly, with a resilient force. Means are provided to rotate drive wheel 26 to move the stamp web. In the embodiment shown, the drive wheel is mounted on output shaft 41*a* of electric motor 41 (FIG. 9). For a more detailed description of this type of dispensing apparatus see U.S. Pat. No. 3,782,616.

In accordance with this invention, means are provided for positioning the stamp web so that the dispensed stamps are severed from the stamp web at a connection between stamps. The positioning means includes a wheel mounted for rotating around an axis transverse to the direction of movement of the stamp web and having a plurality of radially extending ridges parallel to the axis of rotation. As shown in FIG. 2, in this embodiment positioning wheel 16 includes cylindrical hub 45 having a plurality of radially extending plates 46, outer edges 46*a* of which provide spaced transverse ridges located well above the cylindrical outer surface of hub 45 of the wheel. The plates are thin pieces of relatively stiff material mounted in longitudinally extending slots or grooves in hub 45 extending parallel to the axis of rotation of the hub. Attached to the hub at opposite ends are discs or flanges 47 and 48. Each flange has radially extending grooves, such as grooves 49 in flange 48, positioned to receive the radially extending edges of the plates to provide further support for the plates. The hub, the plates, and the two end flanges are assembled to form wheel 16, which is mounted on shaft 50 so that the wheel can freely rotate around the longitudinal axis of the shaft. This axis is transverse to the direction of movement of stamp web 13. The distance between one or more of the connections between the outer edges of each two adjacent ridge plates is equal to the distance between one or more of the connections between stamps in the stamp web. Usually, it will be arranged so that the distance between the outer ridges of the wheel are equal to the distance between each adjacent connection, such as a row of perforations, but this wouldn't necessarily need to be the case. They could be spaced apart the distance between every other row of perforations, if desired.

As shown in FIG. 1, as the stamp web travels around positioning wheel 16 it will engage transverse ridges provided by the outer edges of the plates and due to the tension in the stamp web will bend over these relatively narrow edges. Since the stamp web is structurally weaker at the connections between the stamps, the web will more easily bend at this point, along a row of perforations. Therefore, in accordance with the preferred embodiment of this invention, a positioning wheel is designed for each ridge to engage the web at a connection as the wheel rotates causing the web to bend over the ridges as the web moves around the wheel.

By bending the stamp web over the transverse ridges provided by outer edges 46*a* of plates 46, wheel 16, which is free to rotate, will rotate through an arcuate distance equal to the distance the stamp web is moved since there will be no slippage between the wheel and the moving stamp web.

Also, in accordance with this invention, means are provided to exert a resilient force on the web to hold the web in engagement with the ribs. In accordance with the embodiment shown in FIG. 1, roller 52 is mounted for rotation at one end of arm 53. The other end of arm 53 is pivotally mounted to plate 10 by pivot pin 54. The purpose of this arrangement is to provide a resilient force urging stamp web 13 generally toward the axis of rotation of positioning wheel 16. This can be done by simply providing sufficient weight to the roller and arm to provide the downward force required by gravity or, alternatively, a spring can be provided to resiliently urge the roller against the web. In either event, the force is "resilient" in that it will yield as required to move over the ridges as the wheel rotates. Roller 52 is mounted on arms 53 by pin 55 allowing the roller to rotate freely with respect to the arm.

As said above, roller 52 is used to provide a resilient force to urge the web against the ridges of the positioning wheel and it also serves to insure that the wheel is in the same position at the start of each dispensing operation. For example, if the apparatus of FIG. 1 is dispensing three stamps per operation, in a manner to be described below, the indexing wheel having six ridges each engaging successive connections, such as rows of perforations, will rotate through an angle of 180° per operation. At the end of the operation, roller 52 will be positioned between ridges 46*a* and 46*b*, as shown in FIG. 1. Stamp web 13 will be bent over these ridges and unsupported therebetween. Therefore, due to the downward force of roller 52, wheel 16, which is free to rotate, will inherently move to the position where the roller is equidistance between the rib. In other words, the web between the ridges will curve toward the hub of the wheel due to the force of roller 52 and the roller will force the wheel to rotate until the roller is at the lowest point to which the web moves between the ridges, which will be midway therebetween. Thus, in this manner, after the operation of the apparatus the wheel will inherently return to the same relative position it was in at the beginning of the operation. Thus, by properly positioning the wheel and roller 18 with respect to the position of knife blades 31 and 32, wheel 16 will insure that at the end of the dispensing operation a connection between stamps in the web will be in position to be cut by the knife blades. When manufacturing such apparatus, of course, it would be difficult to hold tolerances so that this would always be the case. Therefore, roller 18 should be mounted so that it is adjustable during the final assembly to correct small errors in manufacturing tolerances after all of the parts have been assembled together.

As described above, means are provided to move the stamp web through the opening (not shown) in the housing through which the stamps are to be dispensed, and further in accordance with this invention, means are provided to stop the web moving means when a preselected number of stamps have been moved into position to be dispensed. In the embodiment shown, flange 48 of wheel 16 is provided with protrusions or cams 60 and 61. Positioned adjacent flange 48 is electrical switch 62 having actuating arm 63 in position to be engaged by cams 60 and 61 as they rotate with the positioning wheel. In the position shown in FIG. 3 with cam 61 in engagement with roller 64 on the actuating arm of the switch, the switch is open and the web moving means is deactuated or stopped. In a manner to be described below, when the apparatus is actuated and the web moving means moves the web though the opening of the housing, switch arm 63 will move off of cam 61 closing switch 62 which will continue the operation of the web moving means until switch 62 is opened by cam 60. This will occur when the wheel has moved through 180° and, as explained above, in this particular embodiment will dispense three stamps.

Figure 4:
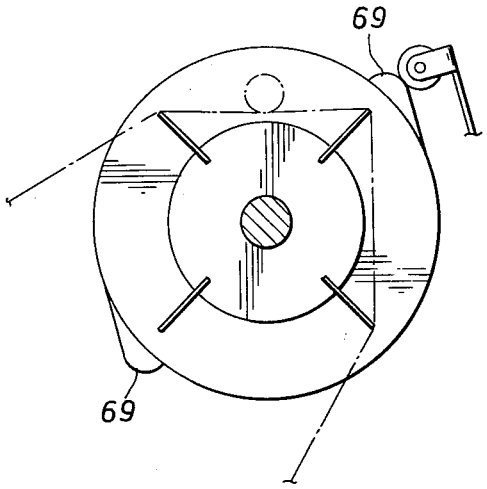
Figure 5:
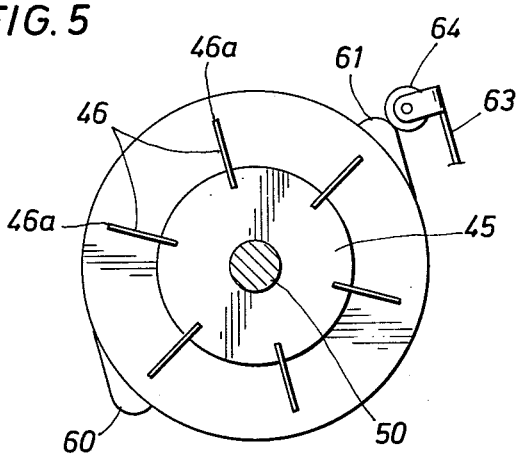
Figure 8:
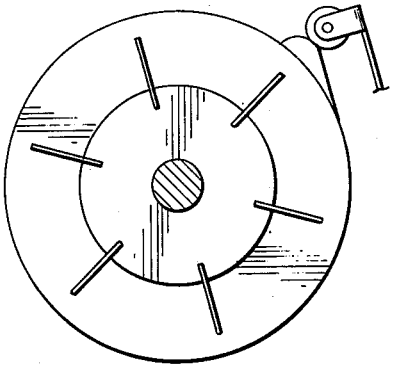

Various other arrangements are shown in FIGS. 3 and 8. For example, in FIG. 3 four cams 65 are provided on flange 66 and hub 67 is provided with four plates 68 to provide four transverse ridges to engage the stamp web. With this wheel, then, the web moving means will be deactuated or stopped after a rotation of 90° by the positioning wheel. Thus, if the ridges are spaced to engage the connectors of the web in sequence, this wheel will dispense one stamp per operation of the apparatus. FIG. 4 shows an embodiment having two cams 69 and again four ridges, but with a rotation of 180° with each actuation of the apparatus, this wheel can be used to dispense two stamps. FIG. 5 is of the same configuration as positioning wheel 16 described above in connection with FIGS. 1 and 2, and is used, as explained above, to dispense three stamps per operation.

Figure 6:
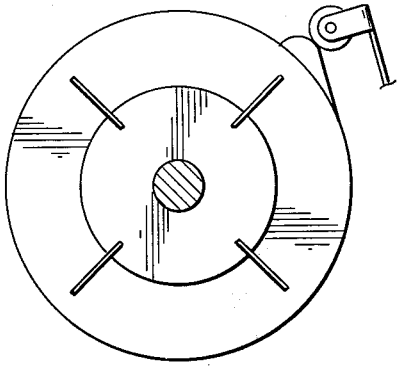
Figure 7:
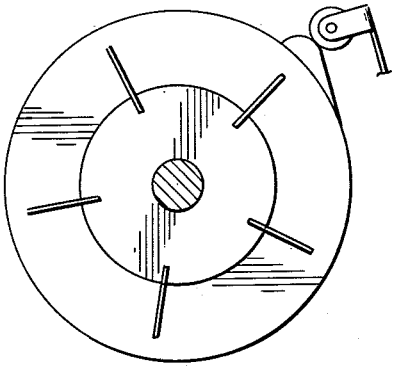

In the same manner, the positioning wheel of FIG. 6 is designed for dispensing four stamps with a 360° rotation of the wheel, FIG. 7 will dispense five stamps again with a 360° rotation of the wheel, and FIG. 8 will dispense six stamps with a 360° rotation of the wheel during each dispensing operation. The wheels shown in FIGS. 3–8 are not to the exact same scale, but it is understood that each wheel is designed so that the distance between the edges of the ridges is such that they will engage the stamp web at the connection between stamps. As explained above, this is because the stamp web will more readily bend at these points under the tension provided in the stamp web by the moving means and by the resilient force supplied through roller 52 and insure that the wheel moves with the web without slippage and will return to the same position after each operation due to the resilient force of roller 52. Should the ridges and the connections of the web not be in engagement, slippage will occur until they are back into engagement.

An electrical circuit for use with the apparatus of FIG. 1 is shown in FIG. 10. Usually stamp machines of this type dispense postage stamps and do so in return for a deposit of a certain amount of money. Therefore, in the circuit, coin operated pulser 80 operates stepper switch 81 to connect power source L1 to line L2 through switch arm 63, contact 86, and pushbutton switch 82 when a predetermined amount of money has been deposited in the coin operated pulser. At this point, then, the machine is ready to operate and when pushbutton switch 82 is closed by the purchaser, the circuit will be completed and relay 83 will be energized. The relay closes switches 83*a* and 83*b*. Switch 83*a* connects line voltage L1 to L2 and supplies relay 83 with power after pushbutton switch 82 is released. Switch 83*b*, when closed by the relay, supplies power to motor 41 and knife solenoid 36. The knife solenoid opens the knife blades to allow the passage of the stamp web, and motor 41 drives wheel 26 and moves the stamp web through the knife blades and opening in the housing.

At the beginning of the operation, switch 62 will be held in the position shown by a cam, such as cam 60 or 61, on flange 48 of the indexing or positioning wheel. Rotation of the wheel by the moving stamp web will move the cam out of engagement with switch arm 63 which will then move into engagement with contact 87 connecting the motor and knife solenoid directly to the source of power connected to switch 62 through line 84. At the same time, relay 83 is deenergized opening switches 83*a* and 83*b*. Motor 41 continues to move the stamp web until a cam on the indexing wheel moves switch arm 63 back to the position shown. This stops the motor and deenergizes the knife solenoid cutting off the dispensed stamps.

The circuit also includes last stamp switch 84 which serves to prevent the operation of the apparatus when the end of the stamp web has passed roller 14, as shown in FIG. 1.

From the foregoing, it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described what is claimed is:

1. Apparatus for dispensing items, such as stamps, tickets, and the like from an elongated web of said items formed by a plurality of the items connected through a backing strip, rows of perforations, and the like, comprising a housing having an opening through which the web is moved when such items are being dispensed, means for moving the web through the opening, means for actuating the web moving means, means for stopping the web moving means when a preselected number of such items have been dispensed, and means to position the web for the dispensed item or items to be severed at a connection between such items and the remaining web, said positioning means including a wheel mounted to rotate freely around an axis transverse the direction of movement of the web, said wheel being positioned for the web to wrap around a portion of the wheel as it moves toward the dispensing opening and having a plurality of ridges parallel to the axis of rotation and spaced to engage the web at the connections between the items forming the web as the wheel is rotated by the moving web, and means providing a resilient force on the web to hold the web in engagement with the wheel sufficient to prevent slippage between the wheel and the moving web, and said means for stopping the web moving means including means responsive to the position of the wheel to stop the web moving means when a preselected number of such items have been dispensed.

2. The apparatus of claim 1 in which the web stopping means includes cam means carried by the positioning wheel.

3. The apparatus of claim 1 in which the means providing a resilient force include a web engaging member, means mounting the member for engagement with the web as it moves over the wheel and for movement toward and away from the web, and resilient means urging the member toward the wheel, said member being positioned to engage the web between two ridges when the wheel is at rest.

4. Apparatus for dispensing items, such as stamps and the like from an elongated web of said items formed by a plurality of the items connected together through a backing strip, rows of perforations, and the like, comprising a housing having an opening through which the web is moved when such items are being dispensed, means for moving the web through the opening, means for actuating the web moving means, means for stopping the web moving means when a preselected number of such items have been dispensed, and means for positioning the web for the dispensed item or items to be severed at a connection between such items and the remaining web, said positioning means including an indexing wheel, means mounting the wheel to rotate freely around an axis transverse the direction of movement of the web and in position for the web to move over the wheel as the web moves to the dispensing opening, said wheel having a plurality of ridges parallel to the axis of rotation of the wheel with each ridge positioned to engage the web at the connections between the items forming the web to bend the web along the line of engagement to cause the wheel to rotate with the web as it is moved, and means exerting a resilient force on the web urging it toward the wheel and positioned to exert said force between two ridges in engagement with the web when the moving means is deactuated to cause the wheel and web to seek a position with the force exerting means midway between said two ridges at the end and start of each dispensing operation to insure that the web is properly positioned for the dispensed items to be severed at a connection between such items and the end of the dispensing operation and said means for stopping the web moving means including means responsive to the position of the wheel to stop the web moving means when a preselected number of such items have been dispensed.

5. The apparatus of claim 4 in which the means for stopping the web includes cam means carried by the wheel.

6. The apparatus of claim 5 in which the cam means stop the web moving means after the indexing wheel has been rotated through an angle equal to a multiple of the angle of the arc subtended by the chord between the outer edges of adjacent ridges.

* * * * *